US008350679B2

(12) United States Patent
Wen et al.

(10) Patent No.: US 8,350,679 B2
(45) Date of Patent: Jan. 8, 2013

(54) CONSUMER PRODUCT KIT HAVING ENHANCED PRODUCT PRESENTATION

(75) Inventors: Cathy Wen, West Chester, OH (US); Kevin Rodgers, Cincinnati, OH (US); Kenneth Stephen McGuire, Cincinnati, OH (US); Robert Joseph Schick, West Chester, OH (US); William Paul Mahoney, III, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 492 days.

(21) Appl. No.: 12/429,518

(22) Filed: Apr. 24, 2009

(65) Prior Publication Data

US 2010/0270198 A1 Oct. 28, 2010

(51) Int. Cl.
*G08B 21/00* (2006.01)

(52) U.S. Cl. ..... 340/309.16; 340/691.1; 362/154

(58) Field of Classification Search ..... 340/309.16, 340/691.1–691.5, 999; 361/679; 362/154
See application file for complete search history.

(56) References Cited

U.S. PATENT DOCUMENTS

| | | | |
|---|---|---|---|
| 4,135,024 | A | 1/1979 | Callahan et al. |
| 4,610,743 | A | 9/1986 | Salmeen |
| 4,797,795 | A | 1/1989 | Callahan |
| 4,931,224 | A | 6/1990 | Holzner, Sr. |
| 5,063,698 | A | 11/1991 | Johnson et al. |
| 5,903,710 | A | 5/1999 | Wefler et al. |
| 5,990,790 | A | 11/1999 | Lusareta |
| 6,241,359 | B1 | 6/2001 | Lin |
| 6,260,703 | B1 | 7/2001 | Morton |
| 6,302,559 | B1 | 10/2001 | Warren |
| 6,348,766 | B1 | 2/2002 | Ohishi et al. |
| 6,361,885 | B1 | 3/2002 | Chou |
| 6,441,921 | B1 | 8/2002 | Soscia |
| 6,740,429 | B2 | 5/2004 | Aziz et al. |
| 6,759,146 | B2 | 7/2004 | Aziz et al. |
| 6,767,654 | B2 | 7/2004 | Tamao et al. |
| 6,897,623 | B2 | 5/2005 | Yoneda et al. |
| 6,924,781 | B1 | 8/2005 | Gelbman |
| 6,980,196 | B1 | 12/2005 | Turner et al. |
| 6,987,787 | B1 | 1/2006 | Mick |
| 7,023,109 | B2 | 4/2006 | Amano |
| 7,212,175 | B1 | 5/2007 | Magee et al. |
| 7,227,313 | B2 | 6/2007 | Huiberts et al. |
| 7,227,652 | B2 | 6/2007 | Cronch et al. |

(Continued)

FOREIGN PATENT DOCUMENTS

| | | | |
|---|---|---|---|
| EP | 1312466 | A1 | 5/2003 |

(Continued)

OTHER PUBLICATIONS

U.S. Appl. No. 12/172,421, filed Jul. 14, 2008, McGuire et al.

(Continued)

*Primary Examiner* — Jeffery Hofsass
(74) *Attorney, Agent, or Firm* — David K Mattheis; Kim W Zerby

(57) ABSTRACT

A product system comprises a package base unit and a package. The package base unit comprises a control element and a package interface operatively connected to the control element. The package comprises a package base interface, and a printed element. The printed element comprises a control circuit element and an output circuit element. Each of the control circuit element and the output circuit element are operatively connected to the package base interface.

19 Claims, 1 Drawing Sheet

U.S. PATENT DOCUMENTS

| | | | | |
|---|---|---|---|---|
| 7,233,831 | B2 | 6/2007 | Blackwell | |
| 7,262,559 | B2 | 8/2007 | Tripathi et al. | |
| 7,317,303 | B1 | 1/2008 | DeVilbiss et al. | |
| 7,345,301 | B2 | 3/2008 | Gerhard et al. | |
| 7,419,072 | B1 | 9/2008 | Vanella | |
| 2005/0140498 | A1 | 6/2005 | Bastian | |
| 2005/0190072 | A1 | 9/2005 | Brown et al. | |
| 2005/0237153 | A1 | 10/2005 | Chen | |
| 2006/0109644 | A1 | 5/2006 | Saucier, Sr. et al. | |
| 2007/0069883 | A1 | 3/2007 | Collier | |
| 2007/0165366 | A1 | 7/2007 | Sokola | |
| 2008/0069725 | A1 * | 3/2008 | Kvietok et al. | 422/4 |
| 2008/0094825 | A1 | 4/2008 | Silver | |
| 2009/0008275 | A1 | 1/2009 | Ferrari et al. | |
| 2009/0084693 | A1 | 4/2009 | Billin | |

FOREIGN PATENT DOCUMENTS

| | | | |
|---|---|---|---|
| EP | 1321287 | A2 | 6/2003 |
| EP | 1736951 | | 12/2006 |
| WO | WO03031170 | A1 | 4/2003 |
| WO | WO 2009/004591 | A | 1/2009 |

OTHER PUBLICATIONS

U.S. Appl. No. 12/424,948, filed Apr. 16, 2009, McGuire et al.

* cited by examiner

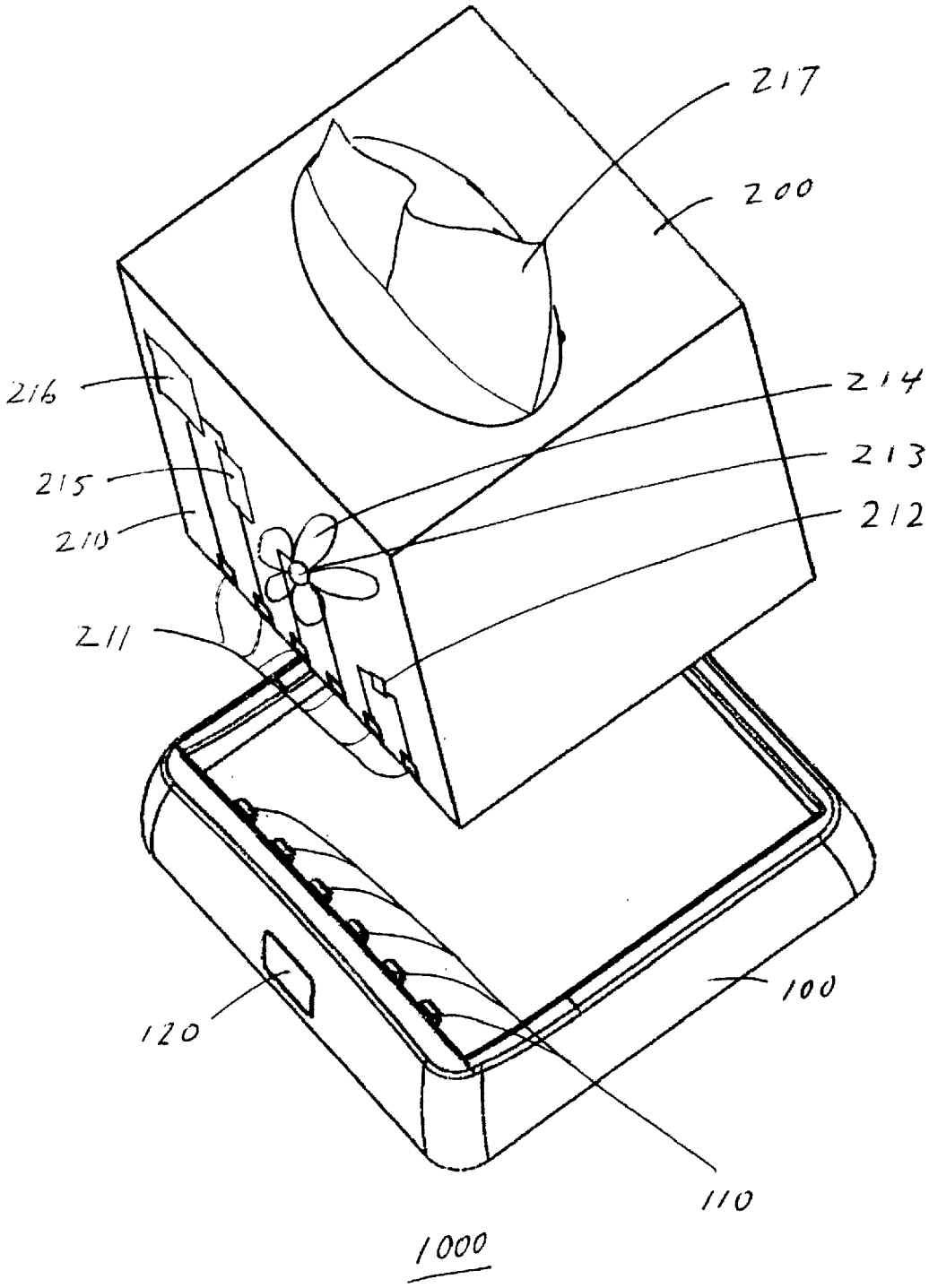
217
200
216
214
215
213
210
212
211
120
100
110
1000

CONSUMER PRODUCT KIT HAVING ENHANCED PRODUCT PRESENTATION

FIELD OF THE INVENTION

This invention relates to the field of consumer products packaging. The invention relates particularly to kits for providing an enhanced consumer product presentation.

BACKGROUND OF THE INVENTION

Consumer product and packaging for these products are well known. One aspect of the interaction of the consumer with the product, or the use of the product by the consumer is the storage of the product between uses.

For some products, it is desirable that the product be openly available in the consumer's environment. This availability may require that the product package be continuously visible in the environment. Packages which are visible in the environment may benefit from having an appearance or functionality which augments or enhances the decor of the environment.

It is desirable to have a kit for providing a consumer product which enables the consumer to augment their decor.

SUMMARY OF THE INVENTION

In one aspect, a product system comprises a package base unit and a package. The package base unit comprises a control element and a package interface operatively connected to the control element. The package comprises a package base interface, and a printed element. The printed element comprises a control circuit element and an output circuit element. Each of the control circuit element and the output circuit element are operatively connected to the package base interface.

In another aspect, a method of controlling an output sequence of a control element for a consumer product package. A package is placed in position upon a package base unit bringing a package interface into contact with a package base interface. An input device is activated to provide an input signal to the controller. A signal is detected in a circuit. The detected signal is compared to a specified signal, and power is provided to an output according to a stored triggering sequence.

BRIEF DESCRIPTION OF THE DRAWINGS

The FIGURE provides an exploded schematic perspective view of a package and a package base unit.

DETAILED DESCRIPTION OF THE INVENTION

A product system comprises a package base unit and a package. The package base unit comprises a control element and a package interface operatively connected to the control element. The package base unit may be composed of polymer materials, metal, wood or glass. The package base unit may be cast, injection molded, blow molded machined or otherwise fabricated using methods known to those of skill in the art depending upon the material chosen.

The control element comprises an integrated circuit. The integrated circuit may contain signal detection circuits and control logic. The control logic may comprise a set of control sequences and interlock circuits. Each of the set of control sequences may be associated with a particular value for an interpreted input signal. The respective control sequences may be used as the basis for providing power to one or more output circuits via the package interface. The interlock circuits may be used to enhance the safety of the system. The interlock may be used to verify the presence of proper output package elements and the presence of an adequate supply voltage. An exemplary integrated circuit is the model uPD78F9201 chip available from NEC Corp., of Irving, Tex.

The package interface comprises a set of conductive contacts disposed in a particular arrangement. At least a portion of each of the contacts is exposed upon an accessible surface of the package base unit. The surface may be exposed and directly accessible or the surface may be accessible after a protective cover is removed. The cover may be removed manually by a consumer or may be automatically moved as the package is placed upon the package base unit. The contacts may be comprised of any conductive material or may have a composite stricture comprising a conductive coating. The contacts may be operatively connected to the pins of the control element integrated circuit or to other circuit elements such as a power supply. One of the contacts may function as a common ground for a number of distinct circuits.

The package base unit may comprise portable energy storage elements, such as batteries, photovoltaic elements, or a connection for interfacing with a line voltage such as a common household electrical outlet, or a combination of these power sources. The power source may be used to provide control and output power for the various circuit elements of the package base unit. The package base unit may comprise a combination of rechargeable batteries and a charging element. The charging element may comprise a hand operated generator operatively connected to a charging circuit and ultimately providing power to the rechargeable batteries, or a transformer, voltage regulator and charging circuit for interfacing the rechargeable batteries with a line voltage. The connector between the package base unit and the line voltage may also function as a base unit mounting element. In one embodiment, the package base unit may be attached to a wall or other surface by being plugged into an electrical receptacle via the line voltage connector.

The package base unit may comprise one or more mounting elements adapted to facilitate attaching the package base unit to horizontal and/or vertical surfaces.

The package base unit may also comprise additional power transforming or regulating circuits and circuit elements. The package base unit may utilize a transformer to convert a supplied voltage to a secondary voltage in order to provide control and output voltages having different magnitudes and types. As a non-limiting example, a transformer may be used to convert a supplied ac voltage to a dc voltage or a supplied dc voltage to an ac voltage.

The package base unit, or the package, may further comprise a switch element. The switch may be operatively connected to an input of the control element and may be used to initiate output sequences or other control sequences. The switch may be remotely actuated using radio frequency, infrared or other electromagnetic remote control systems. The switch may be mechanically linked to a switch operator disposed at least partially upon an accessible surface of the package base unit. The surface may be exposed and directly accessible or the surface may be accessible after a protective cover is removed. The cover may be removed manually by a consumer or may be automatically moved as the package is placed upon the package base unit. The switch may be logically linked to a sensor. Exemplary sensors include, without being limiting, motion sensors, light sensors, ultrasonic sensors, vibration sensors, acceleration sensors, and sound sensors.

The switch operator may comprise a lighting element to provide an indication of the state of any one of the circuit elements of the package base unit. The lighting element may provide an indication that power is being supplied to particular components of the package—package base combination. Alternatively, a lighting element may be disposed upon or within the package base unit separately from the switch operator. In this alternative embodiment, the lighting element may serve the same function as previously described.

In one embodiment, the package base unit may comprise a plurality of package interface elements. The package may comprise a consumer product and may be offered for sale in a retail or other commercial display setting. A package base providing for the concurrent activation of the output elements in a plurality of packages may be provided. Such a base may have a single control element or a plurality of control elements. The base may be provided as a display case, as part of a shipping pallet for a quantity of packages, as a shelf or other wall mounted display, or in other known package display forms. The switch may be configured to activate the output elements associated with a plurality of packages placed adjacent to the plurality of package interface elements. The base may detect the presence of appropriate package control circuit elements associated with each package interface element prior to providing power to each particular package interface element or alternatively to any of the package interface elements.

The package comprises a package base interface, and a printed element. The package base interface comprises a set of conductive contacts arranged in a pattern upon an external surface of the package. The pattern corresponds with the pattern of the contacts of the package interface. The package base interface and the package interface contacts are place in a contacting face-to-face relationship when the package is placed in position upon the package base unit.

The package base unit may comprise a package well defining a position for the placement of the package. The package interface may be incorporated into one or more surfaces of the package well. Placement of the package in the package well may provide face to face contact between the respective package and package base unit interface contacts. The conductive contacts of the package interface may be spring loaded such that the contacts may be shifted in position by the placement of the package into the package well. The spring loading of the contacts may apply a compressive force to the package subsequent to package placement. Such a compressive force may provide the benefit of retaining the package in the package well in opposition to other forces applied to the package.

The package may further comprise a product to be dispensed. The product may be dispensed in any manner known in the packaging arts for dispensing products. Without limiting the invention, products may be dispensed via an aerosol system, a pump system—either manual or powered, by hand, using a scoop or other means, or by gravity. The package may automatically dispense the product according to an external trigger or using an internal interval timer. Sheet products may be dispensed by simply removing one or more sheets from a non-interleaved stack of product sheets. Sheets may also be presented in an interleaved stack wherein removal of a first sheet moves a second sheet into a better position for subsequent removal. The product may be dispensed from the package both when the package is disposed upon the package base unit and/or when it is not.

The package may further comprise a cover portion or a protective overwrap. The cover portion may be hinged or designed to be completely removed to afford the consumer access to the product. The overwrap may be provided to protect the package and/or product from the time of manufacture to the time of actual consumption and use.

The package may be comprised of any packaging materials as are known in the art. Exemplary materials include, without limiting the invention, polymer materials, paper products, metal components, glass and wood components. The package may be formed from an erected package blank, injection molded, blow molded, machined or otherwise formed as is known in the art.

The package may comprise an overwrap for the protection of the package surfaces and/or to provide tamper evident or tamper protection. The overwrap may be configured such that the package base interface may be disposed adjacent to the package interface thereby offering the system in an operable condition.

In one embodiment, the package may comprise a reusable skin or shell which may be used to hold and provide a product. The product may be provided together with the package and refill elements may be provided for use with the package after the originally provided product has been consumed.

The printed element of the package comprises a control circuit element and an output circuit element. Each of the control circuit element and the output circuit element are operatively connected to the package base interface. The control circuit element may comprise a single printed circuit element or a combination of printed circuit elements. The elements may comprise resistors, capacitors, inductors, diodes or other printed electrical components.

The output circuit element may comprise one or more distinct output circuit portions. Each output circuit portion may comprise output elements such as electroluminescent elements, light emitting diode elements, or other printed elements as are known in the art. The printed element may also be interfaced with audio elements or devices such as piezoelectric drivers adapted to dispense scented liquids or other olfactory stimulating substances. In one embodiment, the printed element may comprise printed lighting elements available from Nth Degree Technologies Worldwide, of Tempe, Ariz.

The printed element my further comprise indicia disposed in registration with output elements. In one embodiment, printed artwork comprises a winter themed scene. The scene includes snowflakes, a snowman and a decorated tree. Snowflake and tree ornaments are disposed in registration with electroluminescent output elements. In this embodiment, the decorative elements light up when power is provided to the output channels of the printed element. Indicia may be printed, embossed, debossed or otherwise imparted to the printed element. Indicia may serialized by month, year, numerically or by other basis.

The printed element may be applied to an otherwise completed package. Alternatively, the printed element may form an integral part of the package and may be inseparable from the walls of the package.

The package may comprise artwork and/or indicia in addition to the printed element.

In one embodiment the package printed element comprises a printed label. The label may comprise a laminated stricture. The control circuit element and output elements may be printed upon a base layer. A second layer may be laminated to the base layer with artwork and/or other indicia imparted to the outer surface of the second layer. The label may comprise protective laminated coatings or protective over-coatings such as a protective varnish. The label may comprise an adhesive coating for attaching the label to the package. The label may comprise a thermo plastic coating which may be used to attach the label to the package via a heat activation process. The label may be attached to the package using other adhesive or cohesive systems or may be attached by heat activating an element of the package thereby enabling adherence of the label to the heat activated element. The label may be inserted into a label holding element of the package such as a frame. The label may be secured in place using an interlocking system of tabs, using hook and loop fasteners or otherwise mechanically attached to the package.

In one embodiment the label may be releasably attached to the package. A releasable adhesive system or a mechanical label holding element may be used to enable removal of the label. In this embodiment, an auxiliary base unit may be provided for activating the output elements of the label when the label has been removed from the package. The auxiliary base comprises any of the combinations of the elements of the package base described above absent the package well. The configuration of the auxiliary base comprises a label well or other element for disposing the package base interface of the label adjacent to the package interface element of the auxiliary base unit. The auxiliary base unit provides a means for the continued use and enjoyment of the functions of the label without the necessity of retaining the package as a whole. In this embodiment, the consumer may retain the label and continue to utilize the decorative and other functions of the label after any product provided with the original package has been consumed without needing to retain all portions of the package.

The auxiliary base unit may comprise a single package interface element or a plurality of package interface units. The auxiliary base unit comprising a plurality of package interface units may comprise a single switch for the control of the plurality of interface units or a plurality of switches for the individual control of each interface unit, or for the control of groupings of interface units.

In one embodiment the printed element forms an integral portion of the package. In this embodiment the printed elements may be printed directly upon a surface of the package or supplied as a label and disposed upon a blow molded, injection molded, or rotational molded package using an in mold labeling system.

The juxtaposition of the package interface contacts with the package base interface contacts forms a control circuit and may also form other circuits comprising the output circuit elements. The circuits are formed by the addition of the elements of the printed portion of the package to the circuit portions of the package base unit.

In one embodiment, the package base interface and package interface comprise corresponding sets of six conductive elements arrayed in a regularly spaced linear pattern. In this embodiment, two conductive elements relate to the control circuit element and are disposed adjacent one to the other. A ground contact and three contacts, one for each or three distinct output circuits comprise the remaining four contacts. The three output circuit contacts may be adjacent to each other. The ground contact may be adjacent to the output circuit contacts or it may be separated from the output circuit contacts by the contacts of the control circuit. The specific number and arrangement of conductive contact elements does not limit the invention.

The control element of the package base unit may comprise memory elements. The memory elements may contain a single or a plurality of stored output timing sequences. The stored sequences may determine the order and timing with which power is supplied to respective output circuits. The stored sequences may comprise an absolute sequence of power on and power off timings. The stored sequence may also utilize the random number generating capability of the control element to provide a random provision of power with either a selected or a random channel order.

The nature of the control circuit element of the package may be used to determine which stored control sequence is used. Power may be provided to the control circuit and a signal resulting from powering the circuit may be detected. The nature of the detected signal may be used to determine the nature and value of the control element of the package. The determined nature and value may be used to select the associated stored control sequence.

As an example, the control element of the package may comprise a printed resistor. A known voltage may be applied across the resistor and the resulting voltage drop across the resistor may be determined. Particular stored control sequences may then be selected depending upon the value of the detected voltage drop relative to the supplied voltage. The value of the detected voltage drop will vary according to the value of the printed resistor. Different printed resistor values will yield differing voltage drops allowing for control sequences to be associated with particular resistor values. The applied voltage may change, for example when using batteries to power the device. The detected voltage may be relative to the voltage drop. The detected voltage may also be compared to a range of values to allow for variation in the actual value of the printed resistor. As an example, a particular stored sequence may be associated with a voltage drop of 50% of the applied voltage plus or minus 10%.

The use of the kit by the consumer may include the steps of providing a power source to the package base and placing the package upon the package base unit. The power source may be batteries placed in the base, or connection of the base to a line voltage, or hand craning a generator to charge power storage cells in the package base unit. In one embodiment, the package may be seated in a package well of the package base unit. This placement of the package juxtaposes then package interface and the package base interface. The consumer may actuate the switch element of the package base. This actuation may be accomplished by pressing an accessible switch operator, or via the use of a remote control device, or by triggering a sensor which is linked to the switch. Actuation of the switch triggers the application of power to produce a signal in the control circuit comprising the control element of the package. The applied signal may be modified by the nature of the particular control element and the modified signal may be detected by the control element of the package base unit. The detected modified signal may be compared to predetermined values and used to select from among a set of stored output sequences. The selected output sequence may be used to control the sequence and timing of the application of power to a set of output circuits. The applied signal may be of a short duration and also of a low voltage and/or low amperage. The applied signal may be used to test for the presence of an appropriate package.

The failure of the detected signal to correspond with any of the predetermined values associated with the stored control sequences may be used to prevent the application of power to the output circuit contacts. In this manner, placement of a package which does not have an appropriate control circuit element will not result in the application of power to the output circuit contacts of the package interface. Similarly, the ongoing application of the applied signal together with the detection of the modified signal may be used to terminate the application of power to the output contacts of the package interface when the package is removed from the package base unit.

The package base unit may be configured to provide power for a specified amount of time after, and as long as the proper initial conditions are satisfied. The package base unit may be configured to cease providing power if the switch is actuated a second time while power is being provided to the output contacts. The package base unit may be configured to cease providing power to the output contacts if the supply power of the base unit falls below a predetermined threshold power level.

The control element of the package base unit may provide output power to a single output channel comprising the ground contact and single output contact in the package interface or power may be provided to multiple output channels. The multiple channels may share the common ground contact and may each comprise a distinct output contact.

In one embodiment, the kit may comprise a package base unit and single package. In another embodiment, the kit may comprise a package base unit and a plurality of packages. The plurality of packages may each comprise a similar printed element with the same indicia upon the package. Each of these packages may provide the same response when the package is used in conjunction with the package base unit. Alternatively, the plurality of packages may be provided with substantially different printed elements. The printed elements may differ in terms of the printed control element, the indicia, the placement of output elements, the number of output channels and combinations of these. The plurality of packages may comprise substantially similar products or the plurality of packages may comprise a plurality of products. The kit may optionally include an auxiliary base for exploiting the printed element after the supplied product has been exhausted. The auxiliary base unit may also be provided as a separate item.

Packages comprising differing printed elements as described above may also be offered to the consumer as individual items or in various combinations. The printed elements of the package may vary to provide a different consumer experience with the use of each different package. Package difference may be related to special events or to seasonal changes in décor.

EXAMPLE

As shown in the FIGURE, the product system 1000 comprises a package base unit 100, and a package 200. The package base unit 100 comprises a control element (not shown), a package interface element 110, and a switch element 120. The package 200 comprises a printed element 210. The printed element comprises a package base interface element 211, a control circuit element 212, and a plurality of output circuit elements. Output circuit element 213 comprises a lighting element and is disposed in registration with indicia 214. Output circuit element 215 comprises an audio element and output circuit element 216 comprises an olfactory stimulant delivery system. The product system also includes a sheet type product 217 available for removal from the top of the package 200.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product system comprising a package base unit and a package disposed upon the package base unit, the package base unit comprising a control element, and a package interface operatively connected to the control element, the package comprising a package base interface, and a printed element, the printed element comprising a control circuit element and an output circuit element, each of the control circuit element and the output circuit element operatively connected to the package base interface; wherein the package interface and package base interface are operably connected.

2. The product system of claim 1, the package base unit further comprising a switch element having an operator disposed upon an accessible surface of the product base unit.

3. The product system of claim 1, the package further comprising a product.

4. The product system of claim 1, the output circuit element comprising a lighting element.

5. The product system of claim 4, the package further comprising indicia registered with the lighting element.

6. The product system of claim 4, the lighting element comprising a printed electroluminescent element.

7. The product system according to claim 1, the output circuit element comprising an audio output element.

8. The product system of claim 1, the output circuit element comprising an olfactory stimulant delivery system.

9. The product system of claim 1, the control element further comprising stored control sequences, each stored control sequence associated with a predetermined value of the package control circuit element.

10. A method of controlling an output sequence of a control element, the method comprising steps of:

a. placing a package in position upon a package base bringing a package interface into contact with a package base interface,
b. activating an input device to provide an input signal to the controller,
c. detecting a signal in a circuit,
d. comparing the detected signal to a specified signal, and
e. providing power to an output according to a stored triggering sequence when the detected signal matches the specified signal.

11. The method according to claim 10 further comprising the step of ceasing to trigger outputs after a predetermined amount of time elapses.

12. The method according to claim 10 further comprising the step of ceasing to trigger the outputs when the input device is activated a second time.

13. The method according to claim 10 further comprising the step of ceasing to trigger the outputs when the detected signal fails to match the specified signal.

14. The method according to claim 10 further comprising the step of triggering a plurality of outputs according to a stored triggering sequence.

15. The method according to claim 10 further comprising the step of triggering an output for a calculated random duration of time.

16. The method according to claim 10 further comprising the steps of selecting a stored sequence according to the detected voltage, and triggering an output according to the selected stored sequence.

17. The method according to claim 10 further comprising the step of ceasing to power an output when a detected voltage falls below a specified voltage.

18. The method according to claim 10 comprising the step of comparing the detected signal to a set of specified signals.

19. A product system comprising a package base unit and a package disposed upon the package base unit, the package base comprising a control element further comprising stored control sequences, a switch element having an operator disposed upon an accessible surface of the product base unit, and a package interface operatively connected to the control unit, the package comprising a product, a package base interface operably connected to the packager interface, a printed element, the printed element comprising a control circuit element and at least one output circuit element, each of the control element and the output circuit element operatively connected to the package base interface, wherein each stored control sequence is associated with a predetermined value of the package control element.

* * * * *